US012768242B2

(12) United States Patent
Wang

(10) Patent No.: US 12,768,242 B2
(45) Date of Patent: Oct. 20, 2026

(54) METHOD FOR ENHANCING FORMATION FRACTURE PROPAGATION PRESSURE

(71) Applicant: Chongqing University, Chongqing (CN)

(72) Inventor: HanYi Wang, Chongqing (CN)

( * ) Notice: Subject to any disclaimer, the term of this patent is extended or adjusted under 35 U.S.C. 154(b) by 0 days.

(21) Appl. No.: 19/185,303

(22) Filed: Apr. 22, 2025

(65) Prior Publication Data

US 2026/0275827 A1 Sep. 17, 2026

(30) Foreign Application Priority Data

Mar. 12, 2025 (CN) ..... 202510291665.0

(51) Int. Cl.
*E21B 33/138* (2006.01)

(52) U.S. Cl.
CPC ..... *E21B 33/138* (2013.01)

(58) Field of Classification Search
CPC ..... E21B 33/138; E21B 43/34; C09K 8/34
USPC ..... 166/288
See application file for complete search history.

(56) References Cited

U.S. PATENT DOCUMENTS 7,219,732 B2 * 5/2007 Reddy ..... E21B 33/13 166/387
10,822,916 B2 * 11/2020 Al-Shammari ..... E21B 21/003
10,876,044 B2 * 12/2020 Salla ..... E21B 43/267
2016/0289549 A1 * 10/2016 Nelson ..... C09K 8/703

FOREIGN PATENT DOCUMENTS

CN 114016988 A 2/2022

* cited by examiner

*Primary Examiner* — William D Hutton, Jr.
*Assistant Examiner* — Ashish K Varma

(57) ABSTRACT

A method for enhancing a formation fracture propagation pressure is provided. The method includes: sequentially or simultaneously injecting a first fluid and a second fluid into a formation fracture, or injecting a degradable capsule and a third fluid into the formation fracture, where in case the first fluid and the second fluid are sequentially injected into the formation fracture, the second fluid is configured to displace the first fluid to a fracture tip of the formation fracture; and in case the first fluid and the second fluid are simultaneously injected into the formation fracture, a density of the first fluid is less than or greater than a density of the second fluid. The method can enhance the fracture propagation pressure without altering dimensions of the formation fracture, thereby enhancing the energy storage capacity and hazardous waste storage capacity of the formation fracture.

17 Claims, 5 Drawing Sheets

METHOD FOR ENHANCING FORMATION FRACTURE PROPAGATION PRESSURE

CROSS REFERENCE TO THE RELATED APPLICATIONS

This application is based upon and claims priority to Chinese Patent Application No. 202510291665.0, filed on Mar. 12, 2025, the entire contents of which are incorporated herein by reference.

TECHNICAL FIELD

The present disclosure belongs to the technical field of underground energy storage and deep underground disposal of hazardous waste, and specifically relates to a method for enhancing a formation fracture propagation pressure.

BACKGROUND

Formation fractures can be utilized for energy storage. For example, the Chinese patent application CN114016988A discloses a method and system for energy storage and release through a formation. The disclosure involves creation of at least one formation fracture in a non-hydrocarbon-bearing formation by hydraulic fracturing. A high-pressure fluid is injected into the formation fracture to induce elastic deformation of the formation fracture for energy storage and is flowed back from the formation fracture to release energy through pre-installed power generation equipment.

Formation fractures can also be utilized for hazardous waste storage. For example, over several decades, the Oak Ridge National Laboratory in the United States has injected radioactive fluid waste into artificially created fractures within shale formations for permanent disposal.

The volume of the high-pressure fluid stored in the formation fracture depends on dimensions and fracture propagation pressure of the formation fracture. By injecting the high-pressure fluid into the formation fracture, the fracture width expands, resulting in an increase in both fracture volume and the pressure inside the fracture. When the pressure inside the fracture reaches the fracture propagation pressure, the fracture propagates along its length or height direction.

However, an increasing fracture length will amplify the frictional resistance to fluid flow in the fracture, impairing round-trip efficiency in energy storage. Furthermore, a fracture exceeding its predefined dimensions may trigger uncontrollable geological hazards, such as interconnection with faults or cross-layer fracture propagation.

Currently, rock resistance to fracture propagation can be improved by enhancing rock strength. For example, chemical agents are permeated into rocks, triggering chemical reactions in mineral components within the rocks through silicification or carbonation treatments, thereby generating harder and more stable minerals to improve rock strength. For another example, reinforcing materials such as polymers are injected into natural fissures or pores of rocks to seal them and improve overall rock strength. However, these methods require treatment of entire formation rocks, resulting in prohibitively high costs. These methods can improve rock strength, but they seal existing formation fractures, necessitating the creation of new formation fractures to store the high-pressure fluid. Furthermore, these methods prove ineffective in low-permeability rock formations like shale, as chemical agents and polymers struggle to penetrate the tiny internal pores of shale, making overall strength improvement unachievable.

Given this, how to enhance the fracture propagation pressure of formation fractures with lower treatment costs while maintaining the integrity of original geological fractures, thereby enabling the storage of more high-pressure fluids or hazardous waste without fracture expansion, has become a technical problem that needs to be solved urgently at present.

SUMMARY

The present disclosure aims to address the technical challenge raised in the aforementioned background: cost-effectively enhancing the fracture propagation pressure without compromising existing formation fractures. To this end, the present disclosure proposes a method for enhancing a fracture propagation pressure.

To solve the above technical problem, the present disclosure adopts the following technical solution:

A method for enhancing a formation fracture propagation pressure includes: sequentially or simultaneously injecting a first fluid and a second fluid into a formation fracture, or injecting a degradable capsule and a third fluid into the formation fracture, where the first fluid includes at least one liquid polymer and at least one curing agent; the second fluid is a fluid that does not undergo a curing reaction or a polymerization reaction to form a solid by itself; the degradable capsule includes at least one reactant; the third fluid is a fluid that does not undergo a curing reaction or a polymerization reaction to form a solid by itself; and there is a curing reaction occurring between reactants and/or between the reactant and the third fluid;

in case the first fluid and the second fluid are sequentially injected into the formation fracture, the second fluid is configured to displace the first fluid to a fracture tip of the formation fracture; and in case the first fluid and the second fluid are simultaneously injected into the formation fracture, a density of the first fluid is less than or greater than a density of the second fluid.

Furthermore, after injecting the second fluid to displace the first fluid to the fracture tip of the formation fracture in case the first fluid and the second fluid are sequentially injected into the formation fracture, the method further includes:

stopping, before a fracture pressure of the formation fracture reaches a fracture propagation pressure, injecting the second fluid into the formation fracture; and allowing the first fluid to undergo a curing reaction to transform from a liquid-state material to a solid-state material.

Furthermore, the first fluid further includes a nanoparticle for increasing a fracture toughness and/or a strength of a solid-state material formed by the first fluid through a curing reaction.

Furthermore, before injecting the first fluid into the formation fracture, the first fluid is heated to increase a temperature of the first fluid.

Furthermore, during injection of the first fluid and/or the second fluid into the formation fracture, a formation fracture pressure is greater than a formation fracture closure pressure and less than an original fracture propagation pressure of the formation fracture.

Furthermore, in case the first fluid and the second fluid are sequentially injected into the formation fracture, a viscosity ratio M of the first fluid to the second fluid does not exceed 10.

Furthermore, in case the first fluid and the second fluid are sequentially injected into the formation fracture, the second fluid is added with a thickener to increase a viscosity of the second fluid.

Furthermore, in case the first fluid and the second fluid are sequentially injected into the formation fracture, the density of the second fluid is equal to the density of the first fluid or the density of the first fluid is not less than 70% of the density of the second fluid.

Furthermore, in case the first fluid and the second fluid are sequentially injected into the formation fracture, an injection rate of the second fluid is below a threshold rate, such that the first fluid and/or the second fluid do not generate turbulence in a wellbore or the formation fracture.

Furthermore, in case the first fluid and the second fluid are sequentially injected into the formation fracture, during a curing reaction of the first fluid, no new fluid is injected into the formation fracture or no fluid is flowed back from the formation fracture.

Furthermore, after the first fluid undergoes a curing reaction, the second fluid is flowed back from the formation fracture.

Furthermore, before injecting the first fluid or the second fluid into the formation fracture, a pre-pad fluid including a fluid loss control agent is injected into the formation fracture to reduce a fluid loss from the formation fracture into a surrounding formation.

Furthermore, the first fluid and/or the second fluid injected into the formation fracture include a fluid loss control agent to reduce a fluid loss from the formation fracture into a surrounding formation.

Furthermore, after simultaneously injecting the first fluid and the second fluid into the formation fracture, the method further includes:

stopping, before a fracture pressure of the formation fracture reaches a fracture propagation pressure, injecting the first fluid and the second fluid into the formation fracture; and allowing gravity segregation of the first fluid and the second fluid, causing the first fluid to accumulate at an upper fracture edge or a lower fracture edge of the formation fracture; and allowing the first fluid to undergo a curing reaction to transform from a liquid-state material to a solid-state material.

Furthermore, a fracture toughness of the solid-state material is greater than a fracture toughness of a formation rock where the formation fracture is located; and/or a tensile strength of the solid-state material is greater than a tensile strength of the formation rock where the formation fracture is located; and/or a shear strength of the solid-state material is greater than a shear strength of the formation rock where the formation fracture is located; and/or a compressive strength of the solid-state material is greater than a compressive strength of the formation rock where the formation fracture is located.

Furthermore, after injecting the degradable capsule and the third fluid into the formation fracture, the method further includes:

stopping injecting the degradable capsule while continuing injecting the third fluid, and displacing the degradable capsule to the fracture tip of the formation fracture;

allowing, after the degradable capsule is degraded at the fracture tip of the formation fracture, the curing reaction to occur between the reactants released from the degradable capsule and/or between the reactant and the third fluid to form a solid-state material.

Furthermore, in case the degradable capsule and the third fluid are injected into the formation fracture, a density of the degradable capsule is less than or greater than a density of the third fluid, causing the degradable capsule to accumulate at an upper fracture edge or a lower fracture edge of the formation fracture; and after the degradable capsule is degraded at the upper fracture edge or the lower fracture edge of the formation fracture, the curing reaction occurs between the reactants released from the degradable capsule and/or between the reactant and the third fluid to form a solid-state material.

Furthermore, different reactants are encapsulated in a same degradable capsule or separately encapsulated in different degradable capsules.

Furthermore, the reactant exists in a liquid state or a solid state within the degradable capsule.

Furthermore, after injecting the degradable capsule and the third fluid into the formation fracture, the method further includes:

stopping, before a fracture pressure of the formation fracture reaches a fracture propagation pressure, injecting the degradable capsule and/or the third fluid into the formation fracture.

Furthermore, a fracture toughness of the solid-state material is greater than a fracture toughness of a formation rock where the formation fracture is located; and/or a tensile strength of the solid-state material is greater than a tensile strength of the formation rock where the formation fracture is located; and/or a shear strength of the solid-state material is greater than a shear strength of the formation rock where the formation fracture is located; and/or a compressive strength of the solid-state material is greater than a compressive strength of the formation rock where the formation fracture is located.

The present disclosure has the following beneficial effects:

According to the method for enhancing a fracture propagation pressure provided by the present disclosure, first, a first fluid including one or more liquid polymers and one or more curing agents is injected into a formation fracture. Then, a second fluid is injected into the formation fracture to displace the first fluid to a fracture tip of the formation fracture. Injection of the second fluid is stopped before the fracture pressure reaches a fracture propagation pressure. After the first fluid is cured, the second fluid is flowed back. The first fluid is cured at the fracture tip to form a solid-state material with strength greater than rock strength in the formation, thereby making it hard for the fracture to propagate outward from the tip. The method provided by the present disclosure can enhance the fracture propagation pressure without altering dimensions of the formation fracture, thereby enhancing the energy storage capacity and hazardous waste storage capacity of the formation fracture. Enhance the fracture propagation pressure can also reduce the risk of fatigue induced micro-fracture at fracture tip. The method of the present disclosure relates to hydraulic fracturing technology. As a mature technique in the oil and gas industry, hydraulic fracturing has been widely implemented, ensuring readily available related equipment and controllable costs.

BRIEF DESCRIPTION OF THE DRAWINGS

In order to more clearly illustrate technical solutions in the embodiments of the present disclosure or in the prior art, a brief introduction to the drawings required for the description of the embodiments or the prior art will be provided below. In all the drawings, similar elements or portions are generally identified by similar reference numerals. In the drawings, each element or portion is not necessarily drawn to the actual scale. Apparently, the drawings in the following description show merely some embodiments of the present disclosure, and those of ordinary skill in the art may still derive other drawings from these drawings without creative efforts.

DETAILED DESCRIPTION OF THE EMBODIMENTS

Figure 1:
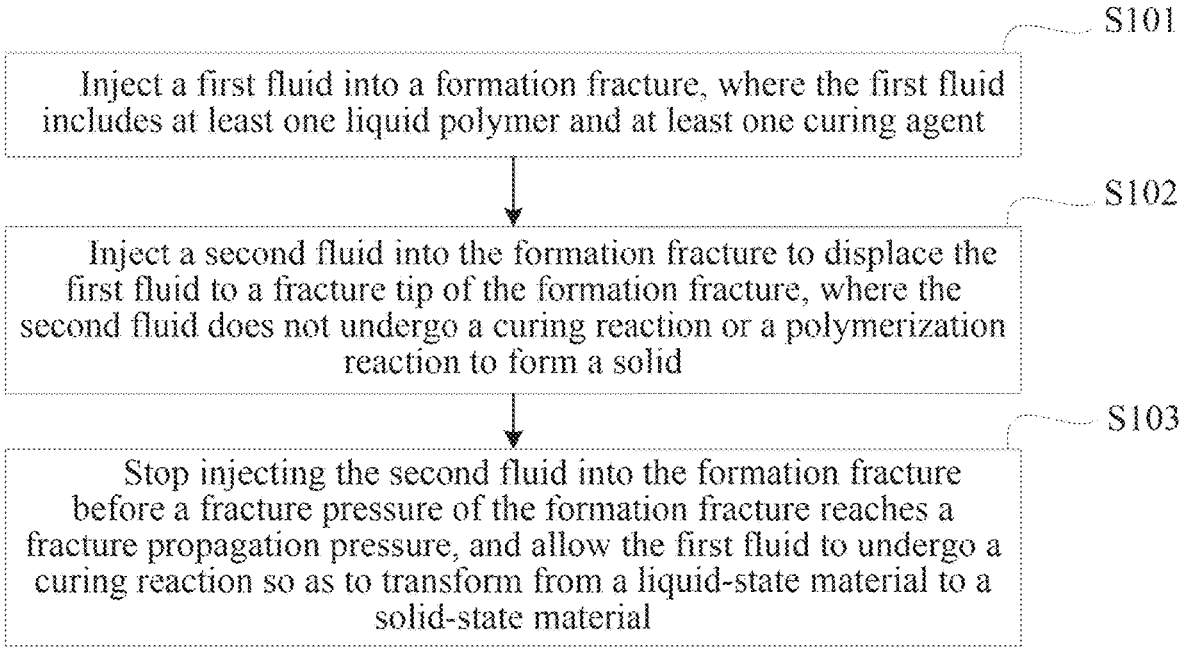
FIG. 1 is a first flowchart of a method for enhancing a formation fracture propagation pressure according to an embodiment of the present disclosure.

To make the objectives, technical solutions, and advantages of the embodiments of the present disclosure clearer, the technical solutions in the embodiments of the present disclosure are clearly and completely described below with reference to the drawings in the embodiments of the present disclosure. Apparently, the described embodiments are merely some rather than all of the embodiments of the present disclosure. All other embodiments obtained by a person of ordinary skill in the art based on the embodiments of the present disclosure without creative efforts shall fall within the protection scope of the present disclosure.

In this document, the term "fluid" may include, but is not limited to, a gas, a liquid, an emulsion, slurry, or a solid particle flow with a liquid-like flow property. For example, the fluid may include a water-based liquid with a chemical additive.

In this document, the term "formation" refers to an underground porous and permeable rock layer (e.g., shale formation, sandstone formation, carbonate formation, etc.) that acts as a storage space for a fluid. The fluid is typically water, a hydrocarbon, or a gas. A fluid loss control agent may be added to the fluid injected into the formation fracture to reduce or prevent fluid leakage from the fracture into the formation.

In this document, the term "hydraulic fracturing," "fracturing," or "rupturing" refers to the generation and propagation of a fracture in a formation rock under an external force (e.g., high-pressure fluid).

In this document, the term "formation fracture" or "fracture" refers to a rock fissure artificially created in the formation after a hydraulic fracturing operation, or an existing natural fracture or fault fissure. The terms "formation fracture" and "fracture" are interchangeable. "Fracture" may denote a single fracture, multiple adjacent fractures at the same location, or a fracture swarm.

In this document, the term "fracture closure pressure" refers to a minimum pressure required to keep the fracture open, which equals the in-situ stress perpendicular to the fracture surface and is typically the minimum principal stress of the formation. For a horizontal fracture, the fracture closure pressure usually equals the vertical principal stress of the formation. For a vertical fracture, the fracture closure pressure usually equals the horizontal minimum principal stress of the formation.

In this document, the term "wellbore" refers to a hole drilled into the formation or formed by inserting a casing. Generally, wellbores are cylindrical with circular cross-sections, though other cross-sectional shapes are possible. A wellbore may be an open-hole wellbore, or a cased wellbore lined with a cemented casing. A wellbore connected to a fracture may be vertical, horizontal, or deviated.

In this document, the term "fracture width" refers to a relative displacement distance between the two walls of the fracture in the direction perpendicular to the formation fracture surface.

In this document, the term "liquid polymer" refers to a class of polymers existing in liquid form at room temperature. They can be cured into a solid form after being mixed with "curing agents" through curing reactions. Common "liquid polymers" include, but are not limited to, polyurethane, polyetheramine, liquid natural rubber, liquid polybutadiene; polyimide precursors, and polyetheretherketone solutions, etc. Common "curing agents" include, but are not limited to, ethylenediamine, triethylenetetramine, m-phenylenediamine, diaminodiphenylmethane, polyamides, modified aliphatic amines, maleic anhydride, hexahydrophthalic anhydride, methyltetrahydrophthalic anhydride, and phenolic modifiers, etc. Common "curing agents" may be categorized as amines, anhydrides, phenolics, metal salts, imidazoles, polyisocyanates, or polysulfides. The time of the curing reaction depends on the types of liquid polymers and curing agents, their mixing ratio, and temperature.

In this document, the term "constant" or "unchanged" does not imply absolute zero variation of a specified item but denotes negligible changes of the specified item such that the specified item can be deemed constant in engineering practices. Similarly, the term "equal/equality" does not mean absolute identity of the specified items but refers to negligible differences in two specified items in engineering practices. For example, "equal/equality" in the present disclosure may also mean "approximately equal/equality."

Embodiment 1

The embodiment of the present disclosure provides a method for enhancing a formation fracture propagation pressure. FIG. 1 shows a flowchart of the method, which includes steps S101 to S103 as detailed below.

S101. A first fluid is injected into a formation fracture, where the first fluid includes at least one liquid polymer and at least one curing agent.

S102. A second fluid is injected into the formation fracture to displace the first fluid to a fracture tip of the formation fracture, where the second fluid is a fluid that does not undergo a curing reaction or a polymerization reaction to form a solid.

S103. Injection of the second fluid into the formation fracture is stopped before a fracture pressure of the formation fracture reaches a fracture propagation pressure. The first fluid undergoes a curing reaction to transform from a liquid-state material to a solid-state material, thereby enhancing the fracture propagation pressure of the formation fracture.

Figure 2:
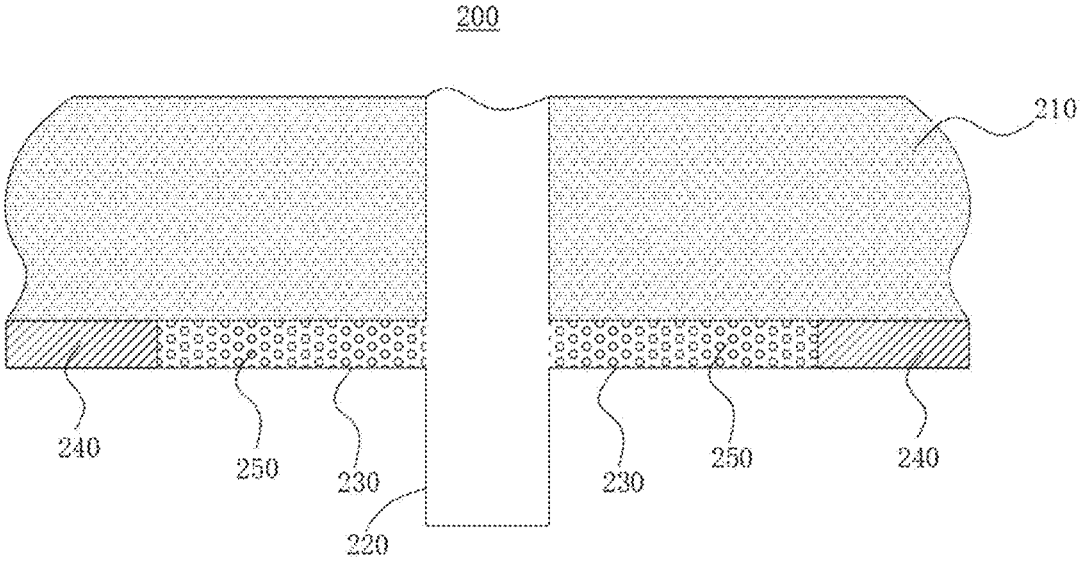
FIG. 2 is a first schematic diagram of the method for enhancing a formation fracture propagation pressure according to an embodiment of the present disclosure.

In an embodiment, as shown in FIG. 2, FIG. 2 illustrates system 200 for injecting first fluid 240 and second fluid 250 into horizontal formation fracture 230 within formation 210 via wellbore 220.

In the system 200, step S101 is first performed as follows. The first fluid 240 is injected into the wellbore 220 to increase a pressure inside the wellbore 220. When the pressure in the wellbore 220 reaches a closure pressure of the formation fracture 230, the formation fracture 230 transitions from a closed state to an open state, allowing the first fluid 240 to enter the formation fracture 230. The first fluid includes one or more liquid polymers and one or more curing agents.

Next, step S102 is performed as follows. The second fluid 250 is injected into the wellbore 220. The second fluid 250 displaces the first fluid 240 to a fracture tip of the formation fracture 230. Any fluid that does not undergo a curing reaction or a polymerization reaction to form a solid may be referred to as the second fluid 250.

It should be noted that the fracture pressure can be obtained by monitoring a wellhead pressure (fracture pressure=wellhead pressure+hydrostatic pressure−frictional resistance). Using a wellbore flow model, a dynamic relationship between the wellhead pressure and the fracture pressure under different injection rates and fluid densities can be calculated.

In other embodiments, the first fluid 240 has a high viscosity (e.g., above 2,000 cP). Viscosity ratio M between the first fluid 240 and the second fluid 250 does not exceed 10. Such a viscosity ratio aims to improve the displacement efficiency of the second fluid 250 over the first fluid 240 in the formation fracture 230 and the wellbore 220, avoid viscous fingering, reduce residual first fluid 240 outside the fracture tip, and prevent mixing of the first fluid and the second fluid in the wellbore 220.

In other embodiments, to increase the viscosity of the second fluid 250, a thickener is added into the second fluid. The thickener includes, but is not limited to, at least one natural polymer and a derivative thereof, and/or at least one cellulose and a derivative thereof, and/or at least one synthetic polymer, and/or at least one surfactant-based thickener, and/or at least one gel-based thickener, and/or at least one clay. Specifically, the thickener may include a natural polymer and a derivative thereof (e.g., guar gum, carboxymethyl guar gum, hydroxypropyl guar gum, xanthan gum, *artemisia* glue), cellulose and a derivative thereof (e.g., hydroxymethyl cellulose, carboxymethyl cellulose, carboxymethyl hydroxyethyl cellulose, hydroxyethyl cellulose), a synthetic polymer (e.g., polyacrylamide, polyethylene oxide, acrylic polymer, polyvinyl alcohol), a surfactant-based thickener, a gel-based thickener (e.g., phenolic resin, guar-crosslinker gel), and a clay (e.g., montmorillonite, bentonite).

In other embodiments, to prevent Rayleigh-Taylor instability in the wellbore 220 due to density differences between the first fluid and the second fluid and avoid stratification of the first fluid and the second fluid in the formation fracture 230, the density of the first fluid 240 must match or approximate that of the second fluid 250. For example, in some embodiments, the density of the first fluid 240 must not fall below 70% of the density of the second fluid 250.

In other embodiments, to prevent turbulent mixing of the first fluid and the second fluid in the wellbore 220 or formation fracture 230 caused by excessive flow rates, an injection rate of the second fluid must remain below a threshold rate. The threshold rate is designed to prevent turbulence of the first fluid and/or the second fluid in the wellbore 220 or formation fracture 230. It can be determined using an empirical formula, a theoretical model, or a numerical simulation based on hydrodynamic properties of the first fluid and/or the second fluid, wellbore and fracture dimensions, and wellbore and fracture surface roughness, etc. For example, the threshold rate may be determined by comparing a calculated Reynolds number against a critical value for turbulence.

Finally, step S103 is performed as follows. Injection of the second fluid 250 is stopped before a fracture pressure of the formation fracture 230 reaches a fracture propagation pressure. The first fluid 240 undergoes a curing reaction into a solid form. The fracture propagation pressure of the formation fracture 230 can be calculated based on dimensions of the formation fracture 230, as well as Young's modulus, Poisson's ratio, and original fracture toughness of a rock in the formation 220. The fracture propagation pressure of the formation fracture 230 can also be derived from a field test by analyzing an injection rate-pressure relationship and a shut-in pressure decline curve. The fracture propagation pressure of the formation fracture 230 can also be calculated based on an empirical formula or a numerical simulation.

It should be noted that the stoppage condition for the second fluid 250 only requires ensuring that the fracture pressure does not exceed the fracture propagation pressure. In a specific implementation, a safety threshold can be predefined based on different application scenarios. The safety threshold can take a value of the fracture propagation pressure. For example, the safety threshold can be set to a MPa, such that injection of the second fluid 250 is stopped before the fracture pressure exceeds a MPa.

To enhance the fracture propagation pressure of the formation fracture 230, a fracture toughness of the solid-state material formed by the first fluid 240 through the curing reaction is required to exceed the fracture toughness of the formation rock where the formation fracture 230 is located. And/or, tensile strength of the solid-state material formed by the first fluid 240 through the curing reaction is required to exceed tensile strength of the formation rock where the formation fracture 230 is located. And/or, shear strength of the solid-state material formed by the first fluid 240 through the curing reaction is required to exceed shear strength of the formation rock where the formation fracture 230 is located. And/or, compressive strength of the solid-state material formed by the first fluid 240 through the curing reaction is required to exceed compressive strength of the formation rock where the formation fracture 230 is located. Because the stress state of the formation fracture 230 varies under different geological conditions, at least one mechanical property of the formation rock, including fracture toughness, tensile strength, shear strength, or compressive strength, affects the fracture propagation pressure of the formation fracture 230.

The curing reaction time of the first fluid 240 is determined by the type of the liquid polymer, the type of the curing agent, the mixing ratio of the liquid polymer to the curing agent, and the formation temperature at the location of the formation fracture 230. The curing reaction time is calculated directly or indirectly from experimental data, empirical formulas, or material datasheets provided by suppliers.

Injection of a new fluid into the formation fracture 230 or flowback of a fluid from the formation fracture 230 is avoided during the curing reaction of the first fluid 240.

In other embodiments, a nanoparticle is added to the first fluid to increase the fracture toughness or strength of the first fluid after curing. The nanoparticle includes but is not limited to carbon nanotube, graphene, nanoclay, nano-silica, nano-alumina, nano-barium titanate, nano-zinc oxide, nano-calcium carbonate, and nano-titanium dioxide.

The second fluid 250 is flowed back after the first fluid 240 is fully cured at the fracture tip of the formation fracture 230. Thus, the fracture propagation pressure of the formation fracture 230 is increased. Subsequently, an energy-storage fluid or hazardous waste can be injected into the formation fracture 230.

In other embodiments, due to high formation permeability or a long curing reaction time of the first fluid 240, the first fluid 240 is fully cured at the fracture tip of the formation fracture 230 and the second fluid 250 is fully leaked off into the formation surrounding the formation fracture 230. In this case, flowback of the second fluid 250 is unnecessary.

It is determined whether the second fluid 250 needs to be flowed back by monitoring a wellhead pressure (and calculating the pressure of the formation fracture 230). For example, if the pressure of the formation fracture 230 exceeds a closure stress of the formation fracture 230 after the curing reaction of the first fluid 240 is completed, there is still the second fluid 250 in the formation fracture 230. In this case, flowback of the second fluid 250 is required. If the pressure of the formation fracture 230 is less than or equal to the closure stress of the formation fracture 230, it is inferred that the formation fracture 230 is completely closed, and the second fluid 250 is fully leaked into the formation 210. In this case, there is no need to flow the second fluid 250 back.

In other embodiments, a pre-pad fluid including a fluid loss control agent is injected into the formation fracture 230 before the first fluid 240 is injected into the formation fracture 230. The pre-pad fluid physically or chemically seals pores in the rock surrounding the formation fracture 230 to reduce fluid leak-off from the formation fracture 230.

In other embodiments, the first fluid 240 and/or the second fluid 250 injected into the formation fracture 230 include a fluid loss control agent.

In other embodiments, the effectiveness of the liquid polymer and the curing agent after the curing reaction can be evaluated by testing the Mode I and/or Mode II and/or Mode III fracture toughness of the solid material formed through the curing reaction. Thus, one or more optimum liquid polymers and one or more optimum curing agents can be selected.

In other embodiments, the effectiveness of the liquid polymer and the curing agent after the curing reaction can be evaluated by direct testing of rock mechanical properties (e.g., compressive strength, tensile strength, or shear strength) of the solid material formed through the curing reaction. Thus, one or more optimum liquid polymers and one or more optimum curing agents can be selected.

In other embodiments, the effectiveness of the liquid polymer and the curing agent after the curing reaction can be evaluated by employing a molecular simulation method to simulate the rock mechanical properties of the solid material formed through the curing reaction. Thus, one or more optimum liquid polymers and one or more optimum curing agents can be selected.

In other embodiments, t the effectiveness of the liquid polymer and the curing agent after the curing reaction can be evaluated by employing a numerical simulation method to simulate the enhancement of the fracture propagation pressure after the curing reaction. Thus, one or more optimum liquid polymers and one or more optimum curing agents can be selected.

In other embodiments, an optimal volume of the first fluid injected is calculated via numerical simulation based on the required formation fracture propagation pressure and the mechanical properties of the first fluid after the curing reaction.

Embodiment 2

Figure 3:
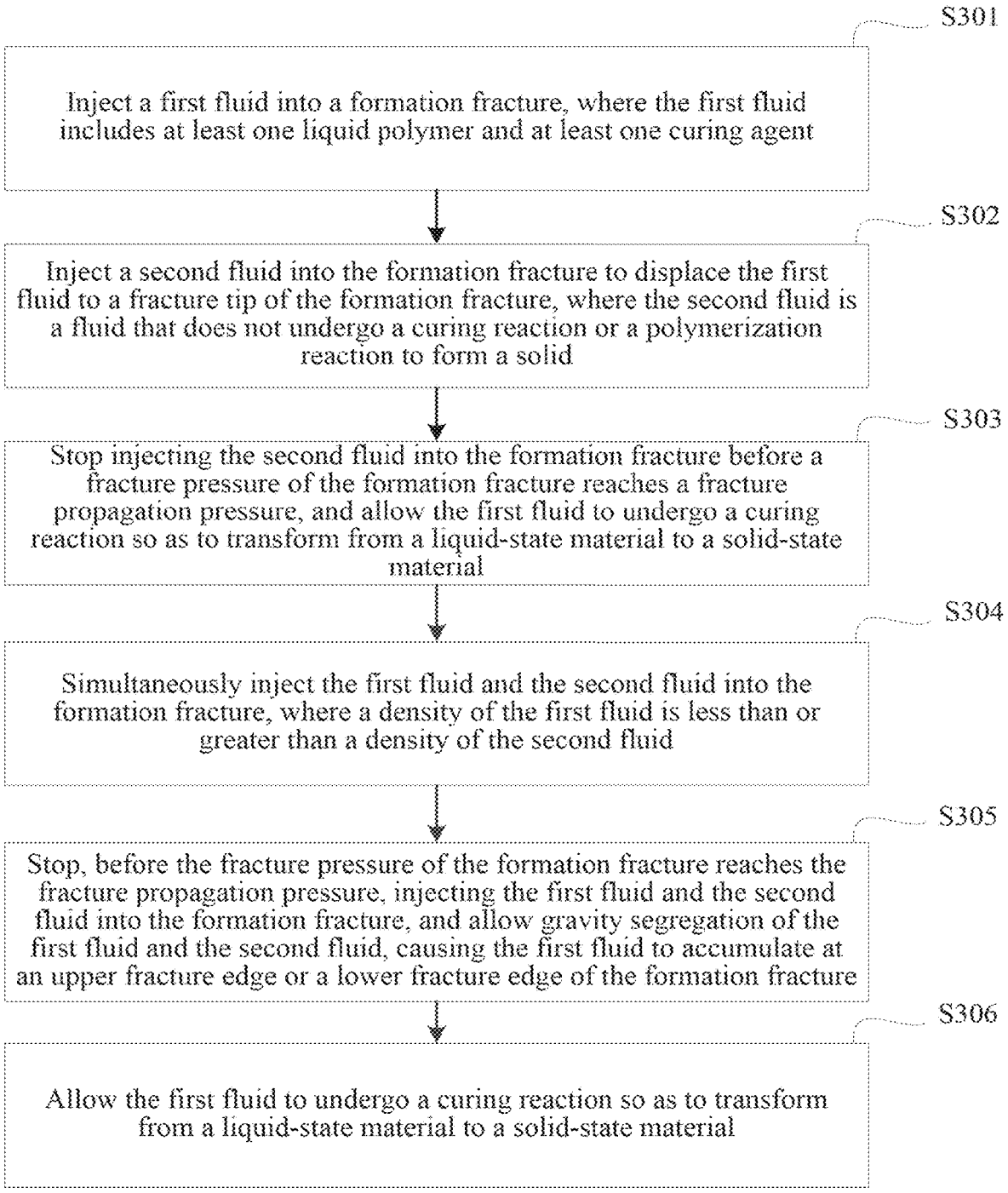
FIG. 3 is a second flowchart of the method for enhancing a formation fracture propagation pressure according to an embodiment of the present disclosure.

The embodiment of the present disclosure provides a method for enhancing a formation fracture propagation pressure. FIG. 3 shows a flowchart of the method, which includes steps S301 to S306 as detailed below.

S301. A first fluid is injected into a formation fracture, where the first fluid includes at least one liquid polymer and at least one curing agent.

S302. A second fluid is injected into the formation fracture to displace the first fluid to a fracture tip of the formation fracture, where the second fluid is a fluid that does not undergo a curing reaction or a polymerization reaction to form a solid.

S303. Injection of the second fluid into the formation fracture is stopped before a fracture pressure of the formation fracture reaches a fracture propagation pressure. The first fluid undergoes a curing reaction to transform from a liquid-state material to a solid-state material, thereby enhancing the fracture propagation pressure of the formation fracture in a length direction.

S304. The first fluid and the second fluid are simultaneously injected into the formation fracture, where a density of the first fluid is less than or greater than a density of the second fluid.

S305. Before the fracture pressure of the formation fracture reaches the fracture propagation pressure, injection of the first fluid and the second fluid into the formation fracture is stopped, and gravity segregation of the first fluid and the second fluid is allowed, causing the first fluid to accumulate at an upper fracture edge or a lower fracture edge of the formation fracture.

S306. The first fluid undergoes a curing reaction to transform from a liquid-state material to a solid-state material, thereby enhancing the fracture propagation pressure of the formation fracture in a height direction.

Figure 4:
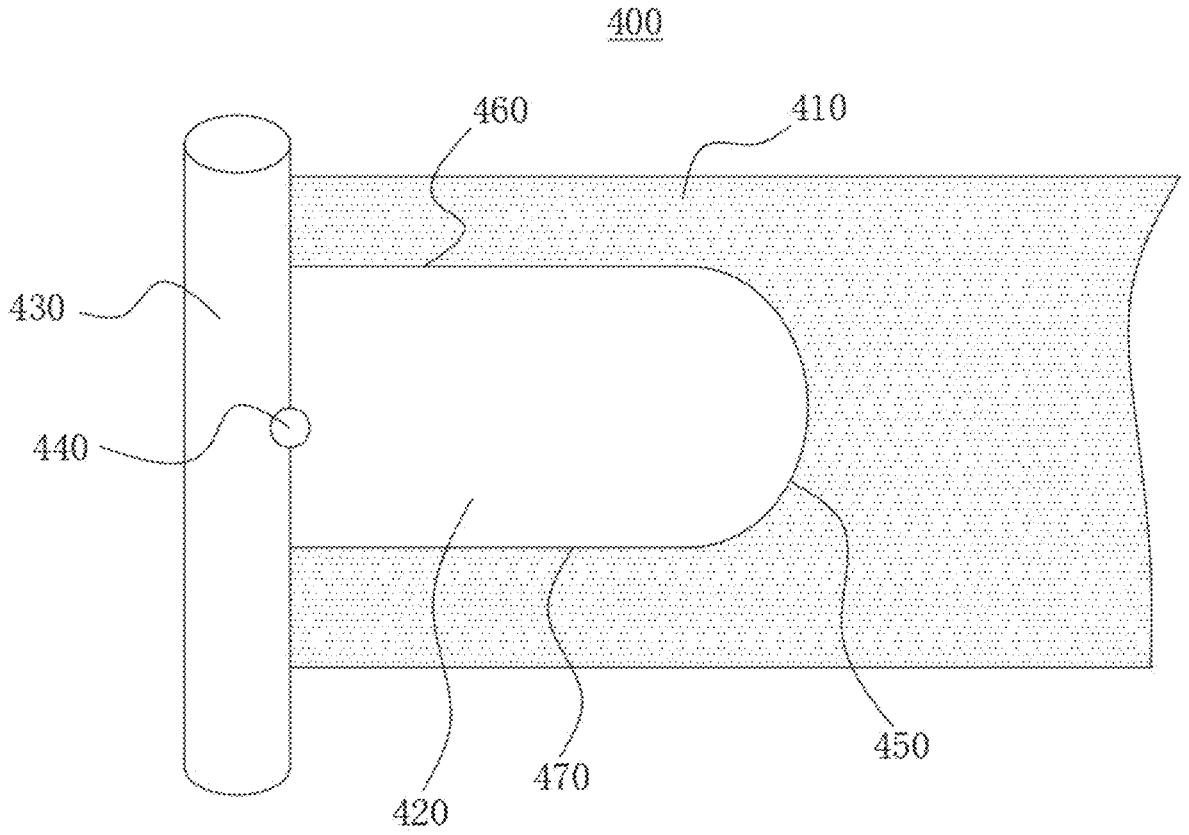
FIG. 4 is a second schematic diagram of the method for enhancing a formation fracture propagation pressure according to an embodiment of the present disclosure.

In an embodiment, FIG. 4 illustrates system 400 including one vertical formation fracture 420 in formation 410. A high-pressure fluid is injected into wellbore 430 and enters the formation fracture 420 through perforation 440. When a fracture pressure in the formation fracture 420 rises to a fracture propagation pressure, the fracture propagates along fracture tip 450 to increase a fracture length. And/or, the fracture propagates upward along upper fracture edge 460 to increase a fracture height. And/or, the fracture propagates downward along lower fracture edge 470 to increase the fracture height. The propagation direction of the formation fracture 420 depends on the spatial distribution of a formation stress and the mechanical properties of the formation rock.

Specifically, the purpose of the steps S301 to S303 is to enhance the propagation pressure of the vertical formation fracture 420 toward the fracture tip 450. The working principle is consistent with that of the steps S101 to S103 in Embodiment 1 and thus is not reiterated here.

In the system shown in FIG. 4, the propagation pressure of the vertical formation fracture 420 toward the fracture tip 450 can be enhanced through the following steps. First, a first fluid is injected into the wellbore 430 and enters the formation fracture 420 through the perforation 440. The first fluid includes one or more liquid polymers and one or more curing agents. Subsequently, a second fluid is injected into the wellbore 430 and enters the fracture 420 through the perforation 440, displacing the first fluid to the fracture tip 450 of the formation fracture 420. Any fluid that does not undergo a curing reaction or a polymerization reaction to form a solid is referred to as the second fluid. Injection of the second fluid is stopped before the fracture pressure of the formation fracture 420 reaches the fracture propagation pressure. The first fluid undergoes a curing reaction at the fracture tip 450 to form a solid-state material with strength exceeding that of the formation rock where the fracture 420 is located. If there is second fluid not leaked off completely in the formation fracture 420, the second fluid is flowed back from the fracture 420.

The purpose of the steps S304 to S306 is to enhance the propagation pressure of the formation fracture 420 propagating upward along the upper fracture edge 460 and/or is to enhance the propagation pressure of the formation fracture 420 propagating downward along the lower fracture edge 470.

To increase the propagation pressure of the formation fracture 420 propagating upward along the upper fracture edge 460, the first fluid and the second fluid are injected into the wellbore 430 and enter the fracture 420 through the perforation 440. The first fluid includes one or more liquid polymers and one or more curing agents. The second fluid will not undergo a curing reaction or a polymerization reaction to form a solid. The density of the first fluid is less than that of the second fluid. Injection of the first fluid and the second fluid is stopped before the fracture pressure of the formation fracture 420 reaches the fracture propagation pressure. Gravity segregation of the first fluid and the second fluid is allowed. The first fluid, due to its lower density than the second fluid, spontaneously moves upward and accumulates near the upper fracture edge 460 of the fracture 420. Furthermore, the first fluid is fully cured into a solid-state material through a curing reaction, with its strength exceeding that of the formation rock where the fracture 420 is located. If there is second fluid not leaked off completely in the formation fracture 420, the second fluid is flowed back from the fracture 420. To increase the propagation pressure of the formation fracture 420 propagating downward along the lower fracture edge 470, the first fluid and the second fluid are injected into the wellbore 430 and enter the formation fracture 420 through the perforation 440. The first fluid includes one or more liquid polymers and one or more curing agents. The second fluid will not undergo a curing reaction or a polymerization reaction to form a solid. The density of the first fluid is greater that of the second fluid. Injection of the first fluid and the second fluid is stopped before the fracture pressure of the formation fracture 420 reaches the fracture propagation pressure. Gravity segregation of the first fluid and the second fluid is allowed. The first fluid, due to its higher density than the second fluid, spontaneously moves downward and accumulates near the lower fracture edge 470 of the fracture 420. Furthermore, the first fluid is fully cured into a solid-state material through a curing reaction, with its strength exceeding that of the formation rock where the fracture 420 is located. If there is second fluid not leaked off completely in the formation fracture 420, the second fluid is flowed back from the fracture 420.

By controlling the injection sequence and densities of the first fluid and the second fluid, the position of the solid material formed by the first fluid through the curing reaction in within fracture is controlled, thereby enhancing the propagation pressure of the fracture in different directions.

In other embodiments, the first fluid and the second fluid are miscible or immiscible.

In other embodiments, to reduce the viscosity of the first fluid, the first fluid is preheated to increase its temperature before it is injected into the wellbore 430.

In other embodiments, to reduce heat transfer from the first fluid to the second fluid, the second fluid is preheated to increase its temperature before it is injected into the wellbore 430.

In other embodiments, the propagation pressure of a formation fracture is determined by the direction with the minimum propagation pressure. Therefore, the enhancement of the fracture propagation pressure only requires increasing the propagation pressure in the corresponding direction of the formation fracture using the first fluid.

In other embodiments, the first fluid is required to accumulate and be cured at multiple fracture tips, multiple upper fracture edges, or multiple lower fracture edges due to the complex geometry of the formation fracture.

In some embodiments, due to the excessively rapid curing reaction rate of the reactants (e.g., polymers and curing agents), they cannot be pre-mixed or prepared in liquid form on the ground. Alternatively, the high viscosity of the liquid polymers results in operation difficulties. Therefore, the reactants can be encapsulated into a degradable (or dissolvable) capsule (referring to any container capable of storing a liquid or powder) and injected into the formation fracture. The degradable capsule includes a water-soluble polymer, a degradable polylactic acid film, or soluble carboxymethyl cellulose. The material ratio and degradation time of the capsule depend on the formation temperature and operational time. In some embodiments, the capsule degrades in 30 to 60 min after contact with water, causing the reactants inside the capsule to release into the formation 30 to 60 min after injection.

Embodiment 3

Figure 5:
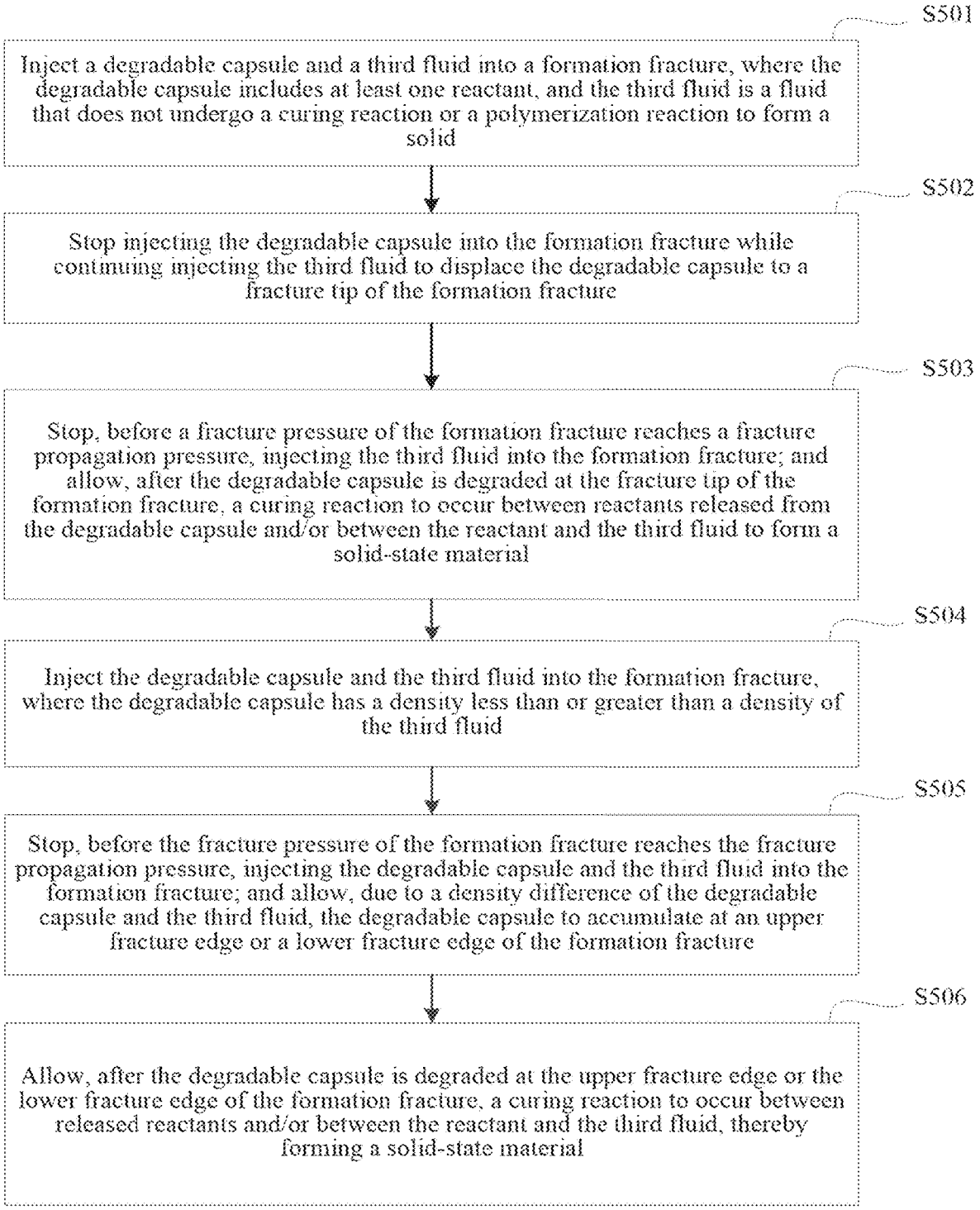
FIG. 5 is a third flowchart of the method for enhancing a formation fracture propagation pressure according to an embodiment of the present disclosure.

The embodiment of the present disclosure provides a method for enhancing a formation fracture propagation pressure. FIG. 5 shows a flowchart of the method, which includes steps S501 to S506 as detailed below.

S501. A degradable capsule and a third fluid are injected into a formation fracture. The degradable capsule includes at least one reactant. The third fluid is a fluid that does not undergo a curing reaction or a polymerization reaction to form a solid by itself.

S502. Injection of the degradable capsule into the formation fracture is stopped, and injection of the third fluid is continued to displace the degradable capsule to a fracture tip of the formation fracture.

S503. Injection of the third fluid into the formation fracture is stopped before a fracture pressure of the formation fracture reaches a fracture propagation pressure. After the degradable capsule is degraded at the fracture tip of the formation fracture, a curing reaction occurs between reactants released from the degradable capsule and/or between the reactant and the third fluid to form a solid-state material, thereby enhancing the fracture propagation pressure of the formation fracture in a length direction.

S504. The degradable capsule and the third fluid are injected into the formation fracture, where the degradable capsule has a density less than or greater than a density of the third fluid.

S505. Injection of the degradable capsule and the third fluid into the formation fracture is stopped before the fracture pressure of the formation fracture reaches the fracture propagation pressure. Due to a density difference of the degradable capsule and the third fluid, the degradable capsule accumulates at an upper fracture edge or a lower fracture edge of the formation fracture.

S506. After the degradable capsule is degraded at the upper fracture edge or the lower fracture edge of the formation fracture, a curing reaction occurs between released reactants and/or between the reactant and the third fluid to form a solid-state material, thereby enhancing the fracture propagation pressure of the formation fracture in a height direction.

Figure 6:
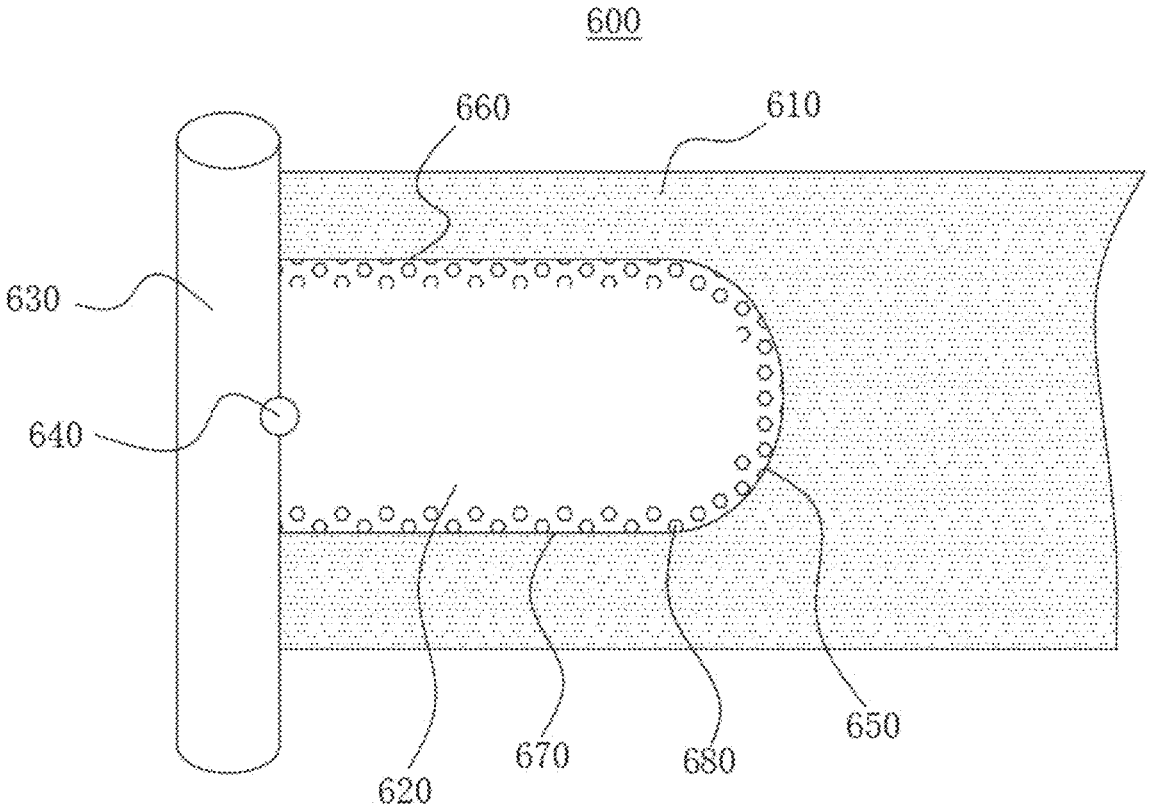
FIG. 6 is a third schematic diagram of the method for enhancing a formation fracture propagation pressure according to an embodiment of the present disclosure.

In an embodiment, FIG. 6 illustrates system 600 including one vertical formation fracture 620 in formation 610. A high-pressure fluid is injected into wellbore 630 and enters the formation fracture 620 through perforation 640. When a fracture pressure in the formation fracture 620 rises to a fracture propagation pressure, the fracture propagates along fracture tip 650 to increase a fracture length. And/or, the fracture propagates upward along upper fracture edge 660 to increase a fracture height. And/or, the fracture propagates downward along lower fracture edge 670 to increase the fracture height. The propagation direction of the formation fracture 620 depends on the spatial distribution of a formation stress and the mechanical properties of the formation rock.

In the system shown in FIG. 6, specifically, the propagation pressure of formation fracture 620 toward fracture tip 650 is enhanced through the following steps. First, degradable capsule 680 and a third fluid are injected into wellbore 630 and enter formation fracture 420. The degradable capsule includes at least one reactant. The third fluid is a fluid that does not undergo a curing reaction or a polymerization reaction to form a solid. Subsequently, injection of the degradable capsule 680 into the formation fracture is stopped, while injection of the third fluid is continued to displace the degradable capsule to the fracture tip 650 of the formation fracture. Injection of the third fluid is stopped before the fracture pressure of the formation fracture 420 reaches the fracture propagation pressure. After the degradable capsule 680 is degraded at the fracture tip 650 of the formation fracture 620, a curing reaction occurs between reactants released from the degradable capsule 680 and/or between the reactant and the third fluid to form a solid-state material, thereby enhancing the fracture propagation pressure of the formation fracture 620 in a length direction. In the system shown in FIG. 6, specifically, the propagation pressure of the formation fracture 620 in a height direction can be enhanced through the following steps. The degradable capsule 680 and the third fluid are injected into the formation fracture 620, where the degradable capsule has a density less than or greater than a density of the third fluid. Injection of the degradable capsule 680 and the third fluid into the formation fracture 620 is stopped before the fracture pressure of the formation fracture 620 reaches the fracture propagation pressure. Due to a density difference of the degradable capsule 680 and the third fluid, the degradable capsule 680 accumulates at the upper fracture edge 660 or lower fracture edge 670 of the formation fracture 620. After the degradable capsule 680 is degraded at the upper fracture edge 660 or lower fracture edge 670 of the formation fracture 620, a curing reaction occurs between the released reactants and/or between the reactant and the third fluid to form a solid-state material, thereby enhancing the fracture propagation pressure of the formation fracture 620 in the height direction.

In some embodiments, the degradable capsule and the third fluid are injected into the formation fracture. The degradable capsule includes at least one reactant, and the third fluid is a fluid that does not undergo a curing reaction or a polymerization reaction to form a solid. Injection of the degradable capsules is stopped while injection of the third fluid is continued to displace the degradable capsule to the fracture tip of the formation fracture. After the degradable capsule is degraded at the fracture tip of the formation fracture, a curing reaction occurs between the reactants released from the degradable capsule and/or between the reactant and the third fluid to form a solid-state material.

In some embodiments, the degradable capsule and the third fluid are injected into the formation fracture. The degradable capsule has a density less than or greater than a density of the third fluid, such that the degradable capsule is accumulated at the upper fracture edge or the lower fracture edge of the formation fracture. After the degradable capsule is degraded at the upper fracture edge or the lower fracture edge of the formation fracture, a curing reaction occurs between the reactants released from the degradable capsule and/or between the reactant and the third fluid to form a solid-state material.

In some embodiments, different reactants are encapsulated in the same degradable capsule. In other embodiments, different reactants are encapsulated in separate degradable capsules. For example, a powder-state polymer and a powder-state curing agent are placed in the same capsule to avoid any curing reaction. However, after the capsule is injected and degraded in the formation fracture, the released polymer and curing agent powders undergo a curing reaction upon contact with water.

The reactant in the degradable capsule may be in liquid or solid (including powder) form. The degradable capsules may also include an additional substance to adjust the capsule density.

The above embodiments are provided merely for describing the technical solutions of the present disclosure, but not for limiting the present disclosure. Although the present disclosure is described in detail with reference to the above examples, a person of ordinary skill in the art should understand that they may still make modifications to the technical solutions described in the above examples or make equivalent replacements to some or all technical features thereof; and these modifications or replacements do not make the essence of the corresponding technical solution depart from the scope of the technical solutions of the examples of the present disclosure, and shall fall within the scope of claims and specification of the present disclosure.

What is claimed is:

1. A method for enhancing a formation fracture propagation pressure, comprising:

injecting a first fluid via a wellbore into a formation fracture, wherein the first fluid comprises at least one liquid polymer and at least one curing agent;

injecting a second fluid via the wellbore into the formation fracture, thereby displacing the first fluid to a fracture tip of the formation fracture, wherein the second fluid does not undergo a curing reaction or a polymerization reaction to form a solid by itself, and wherein a density of the second fluid differs from a density of the first fluid;

stopping the injection of the second fluid before a fracture pressure of the formation fracture reaches a fracture propagation pressure;

segregating the first fluid from the second fluid via gravity and due to the different densities of the first and second fluids, thereby accumulating the first fluid near either an upper fracture edge or a lower fracture edge of the formation fracture; and reacting the at least one liquid polymer with the at least one curing agent and transforming the first fluid from a liquid-state material to a solid-state material, thereby curing the first fluid and enhancing the formation fracture propagation pressure.

2. The method according to claim 1, wherein the first fluid further comprises a nanoparticle for increasing a fracture toughness and/or a strength of the solid-state material.

3. The method according to claim 1, wherein, before injecting the first fluid into the formation fracture, the first fluid is heated to increase a temperature of the first fluid.

4. The method according to claim 1, wherein, during injection of the first fluid and/or the second fluid into the formation fracture, a formation fracture pressure is greater than a formation fracture closure pressure and less than an original fracture propagation pressure of the formation fracture.

5. The method according to claim 1, wherein a viscosity ratio of the first fluid to the second fluid does not exceed 10.

6. The method according to claim 1, wherein the second fluid comprises a thickener to increase a viscosity of the second fluid.

7. The method according to claim 1, wherein the density of the first fluid is not less than 70% of the density of the second fluid.

8. The method according to claim 1, wherein an injection rate of the second fluid is below a threshold rate, such that the first fluid and/or the second fluid does not generate turbulence in wellbore or the formation fracture.

9. The method according to claim 1, wherein, during the curing reaction of the first fluid, no new fluid is injected into the formation fracture or no fluid is flowed back from the formation fracture.

10. The method according to claim 1, wherein, after the first fluid curing reaction, the second fluid is flowed back from the formation fracture.

11. The method according to claim 1, wherein, before injecting the first fluid or the second fluid, a pre-pad fluid comprising a fluid loss control agent is injected into the formation fracture to reduce a fluid loss from the formation fracture into a surrounding formation.

12. The method according to claim 1, wherein the first fluid and/or the second fluid comprise a fluid loss control agent to reduce a fluid loss from the formation fracture into a surrounding formation.

13. The method according to claim 1, wherein a fracture toughness of the solid-state material is greater than a fracture toughness of a formation rock where the formation fracture is located; and/or a tensile strength of the solid-state material is greater than a tensile strength of the formation rock where the formation fracture is located; and/or a shear strength of the solid-state material is greater than a shear strength of the formation rock where the formation fracture is located; and/or a compressive strength of the solid-state material is greater than a compressive strength of the formation rock where the formation fracture is located.

14. A method for enhancing a formation fracture propagation pressure, comprising:

injecting degradable capsules, wherein the degradable capsules comprise at least one reactant;

injecting a fluid into the formation fracture, wherein the fluid does not undergo a curing reaction or a polymerization reaction to form a solid by itself, and wherein a density of the fluid differs from a density of the degradable capsules;

stopping the injection of the degradable capsules;

continuing injection of the fluid, thereby displacing the degradable capsules to a fracture tip of the formation fracture;

stopping the injection of the fluid before a fracture pressure of the formation fracture reaches a fracture propagation pressure;

accumulating the degradable capsules near either an upper fracture edge or a lower fracture edge of the formation fracture due to the different densities of the degradable capsules and the fluid;

degrading the degradable capsules, thereby releasing the at least one reactant; and reacting the fluid with the at least one reactant to form a solid-state material, thereby enhancing the formation fracture propagation pressure.

15. The method according to claim 14, wherein different reactants are encapsulated in a same degradable capsule or separately encapsulated in different degradable capsules.

16. The method according to claim 14, wherein the at least one reactant exists in a liquid state or a solid state within the degradable capsules.

17. The method according to claim 14, wherein a fracture toughness of the solid-state material is greater than a fracture toughness of a formation rock where the formation fracture is located; and/or a tensile strength of the solid-state material is greater than a tensile strength of the formation rock where the formation fracture is located; and/or a shear strength of the solid-state material is greater than a shear strength of the formation rock where the formation fracture is located; and/or a compressive strength of the solid-state material is greater than a compressive strength of the formation rock where the formation fracture is located.

* * * * *